United States Patent [19]

Galand et al.

[11] Patent Number: 5,001,758

[45] Date of Patent: Mar. 19, 1991

[54] VOICE CODING PROCESS AND DEVICE FOR IMPLEMENTING SAID PROCESS

[75] Inventors: Claude Galand; Jean Menez, both of Cagnes Sur Mer, France

[73] Assignee: International Business Machines Corporation, Armonk, N.Y.

[21] Appl. No.: 35,806

[22] Filed: Apr. 8, 1987

[30] Foreign Application Priority Data

Apr. 30, 1986 [EP] European Pat. Off. ..... 86430014

[51] Int. Cl.[5] ..... G10L 3/02

[52] U.S. Cl. ..... 381/36; 381/40; 381/49

[58] Field of Search ..... 364/513.5; 381/29-49

[56] References Cited

U.S. PATENT DOCUMENTS

| | | | |
|---|---|---|---|
| 4,216,354 | 8/1980 | Esteban et al. | 381/31 |
| 4,330,689 | 5/1982 | Kang et al. | 381/31 |
| 4,495,620 | 1/1985 | Steele et al. | 381/31 |
| 4,535,472 | 8/1985 | Tomcik | 381/31 |
| 4,569,075 | 2/1986 | Nussbaumer | 381/29 |
| 4,667,340 | 5/1987 | Arjmand et al. | 381/31 |
| 4,672,670 | 6/1987 | Wang et al. | 381/31 |
| 4,704,730 | 11/1987 | Turner et al. | 381/36 |

OTHER PUBLICATIONS

Sondhi, "New Methods of Pitch Extraction," IEEE Trans. Audio Electroacoust., vol. AU-16, pp. 262-266, June 1968.

Dubnowski, Schafer and Rabiner, "Real-Time Digital Hardware Pitch Detector", IEEE Trans. Acoust, Speech, Signal Processing, vol. ASSP-24, pp. 2-8, Feb. 1976.

Esteban, Galand, Mauduit, and Menez, "9.6/7.2 KBPS Voice Excited Predictive Coder (VEPC)" 1978 ICASSP, Tulsa.

Esteban and Galand, "32 KBPS CCITT Compatible Split Band Coding Scheme", 1978 ICASSP, Tulsa.

Croisier, "Progress in PCM and Delta Modulation: Block-Companded Coding of Speech Signals," 1974 Zurich Seminar.

Zinsor, "An Efficient, Pitch-Aligned High-Frequency Regeneration Technique for BELP Vocoders", IEEE ICASSP, Mar. 1985, pp. 969-972.

Griffin et al., "Multiband Excitation Vocoder", IEEE Trans. on ASSP, vol. 36, No. 8, Aug. 1988, pp. 1223-1235.

Tribolet et al., "Frequency Domain Coding of Speech", IEEE Trans. on ASSP, vol. 27, No. 5, Oct. '79, pp. 512-530.

*Primary Examiner*—Gary V. Harkcom
*Assistant Examiner*—David D. Knepper
*Attorney, Agent, or Firm*—John B. Frisone

[57] ABSTRACT

The voice signal is analyzed to derive therefrom a low frequency base band signal, linear prediction coefficients and high frequency (HF) descriptors. Said HF descriptors include HF energy indications as well as indications relative to the phase shift between the low frequency and the high frequency band. Said HF descriptors are used during the voice synthesis operation to provide an inphase HF bandwidth component to be added to the base band prior to be used for driving a linear prediction synthesis filter tuned using said linear prediction parameters.

17 Claims, 11 Drawing Sheets

VOICE CODING PROCESS AND DEVICE FOR IMPLEMENTING SAID PROCESS

TECHNICAL FIELD

This invention deals with voice coding and more particularly with a method and system for improving said coding when performed using base-band (or residual) coding techniques.

BACKGROUND OF INVENTION

Base-band or residual coding techniques involve processing the original signal to derive therefrom a low frequency bandwidth signal and a few parameters characterizing the high frequency bandwidth signal components. Said low and high frequency components are then respectively coded separately. At the other end of the process, the original voice signal is obtained by adequately recombining the coded data. The first set of operations is generally referred to as analysis, as opposed to synthesis for the recombining operations.

Obviously any processing involving coding and decoding degrades the voice signal and is said to generate noises. This invention, further described with reference to an example of base-band coding technique, i.e. known as Residual-Excited Linear Prediction Vocoding (RELP), but valid for any base-band coding technique, is made to lower substantially said noise.

RELP analysis generates, in addition to the low frequency bandwidth signal, parameters relating to the high frequency bandwidth energy content and to the original voice signal spectral characteristics.

RELP methods enable reproducing speech signals with communications quality at rates as low as 7.2 Kbps. For example, such a coder has been described in a paper by D. Esteban, C. Galand, J. Menez, and D. Mauduit, at the 1978 ICASSP in Tulsa: '7.2/9.6 kbps Voice Excited Predictive Coder'. However, at this rate, some roughness remains in some synthesized speech segments, due to a non-ideal regeneration of the high-frequency signal. Indeed, this regeneration is implemented by a straight non-linear distortion of the analysis generated base-band signal, which spreads the harmonic structure over the high-frequency band. As a result, only the amplitude spectrum of the high-frequency part of the signal is well regenerated, while the phase spectrum of the reconstructed signal does not match the phase spectrum of the original signal. Although this mismatching is not critical in stationary portions of speech, like sustained vowels, it may produce audible distortions in transient portions of speech, like consonants.

SUMMARY OF THE INVENTION

The invention is a voice coding process wherein the original voice signal is analyzed to derive therefrom a low frequency bandwidth signal and parameters characterizing the high frequency bandwidth components of said voice signal the original parameters including energy indications about said high frequency bandwidth signal, with the voice coding process being further characterized in that said analysis is made to provide further additional parameters including information relative to the phase-shift between low and high frequency bandwidth contents, from which the voice signal may be synthesized by combining the in phase high and low frequency bandwidth content.

It is an object of this invention to provide means for enabling in phase regeneration of HF bandwidth contents.

The foregoing and other objects, features and advantages of the invention will be made apparent from the following more particular description of the preferred embodiment of the invention as illustrated in the accompanying drawings.

BRIEF DESCRIPTION OF THE DRAWINGS

FIG. 3*a* speech signal

FIG. 3*b* residual signal

FIG. 3*c* base-band signal x(n)

FIG. 3*d* high-band signal y(n)

FIG. 3*e* high-band signal synthesized by conventional RELP

FIG. 3*f* pulse train u(n)

FIG. 3*g* cleaned base-band pulse train z(n)

FIG. 3*h* windowing signal w(n)

FIG. 3*i* windowed high-band signal y" (n)

FIG. 3*j* high-band signal s(n) synthesized by the improved method

DESCRIPTION OF A PREFERRED EMBODIMENT.

The following description will be made with reference to a residual-excited linear prediction vocoder (RELP), an example of which has been described both at the ICASSP Conference cited above and in European Patent No. 0002998, which deals more particularly with a specific kind of RELP coding, i.e. Voice Excited Predictive Coding (VEPC).

Figure 1:
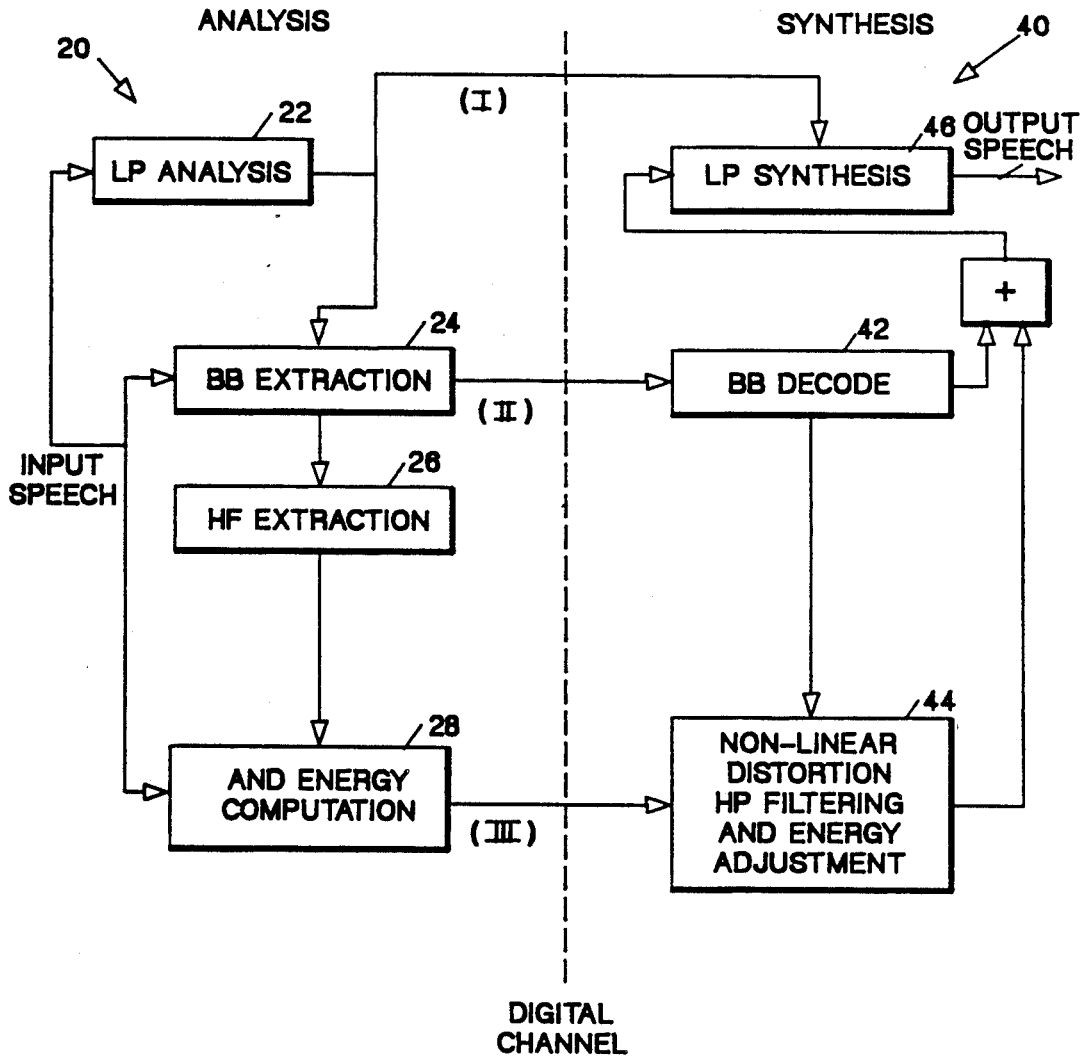
FIG. 1 PRIOR ART
FIG. 1 is a general block diagram of a conventional RELP vocoder.

FIG. 1 represents the general block diagram of such a conventional RELP vocoder including both devices, i.e. an analyzer 20 and a synthesizer 40. In the analyzer 20 the input speech signal is processed to derive therefrom the following set of speech descriptors:

(I) the spectral descriptors represented by a set of linear prediction parameters (see LP Analysis 22 in FIG. 1), (II) the base-band signal obtained by band limiting (300–1000 Hz) and subsequently sub-sampling at 2 kHz the residual (or excitation) signal resulting from the inverse filtering of the speech signal by its predictor (see BB Extraction 24 in FIG. 1) or by a conventional low frequency filtering operation, (III) the energy of the upper band (or High-Frequency band) signal (1000 to 3400 Hz) which has been removed from the excitation signal by low-pass filtering (see HF Extraction 26 and Energy Computation 28).

These speech descriptors are quantized and multiplexed to generate the coded speech data to be provided to the speech synthesizer 40 whenever the speech signal needs be reconstructed.

The synthesizer 40 is made to perform the following operations:

decoding and up-sampling to 8 kHz of the Base-Band signal (see BB Decode 42 in FIG. 1)

generating a high frequency signal (1000–3400 Hz) by non-linear distortion high-pass filtering and energy adjustment of the base-band signal (see Non Linear Distortion HP Filtering and Energy Adjustment 44)

exciting an all-pole prediction filter (see LP Synthesis 46) corresponding to the vocal tract by the sum of the base-band signal and of the high-frequency signal.

Figure 2:
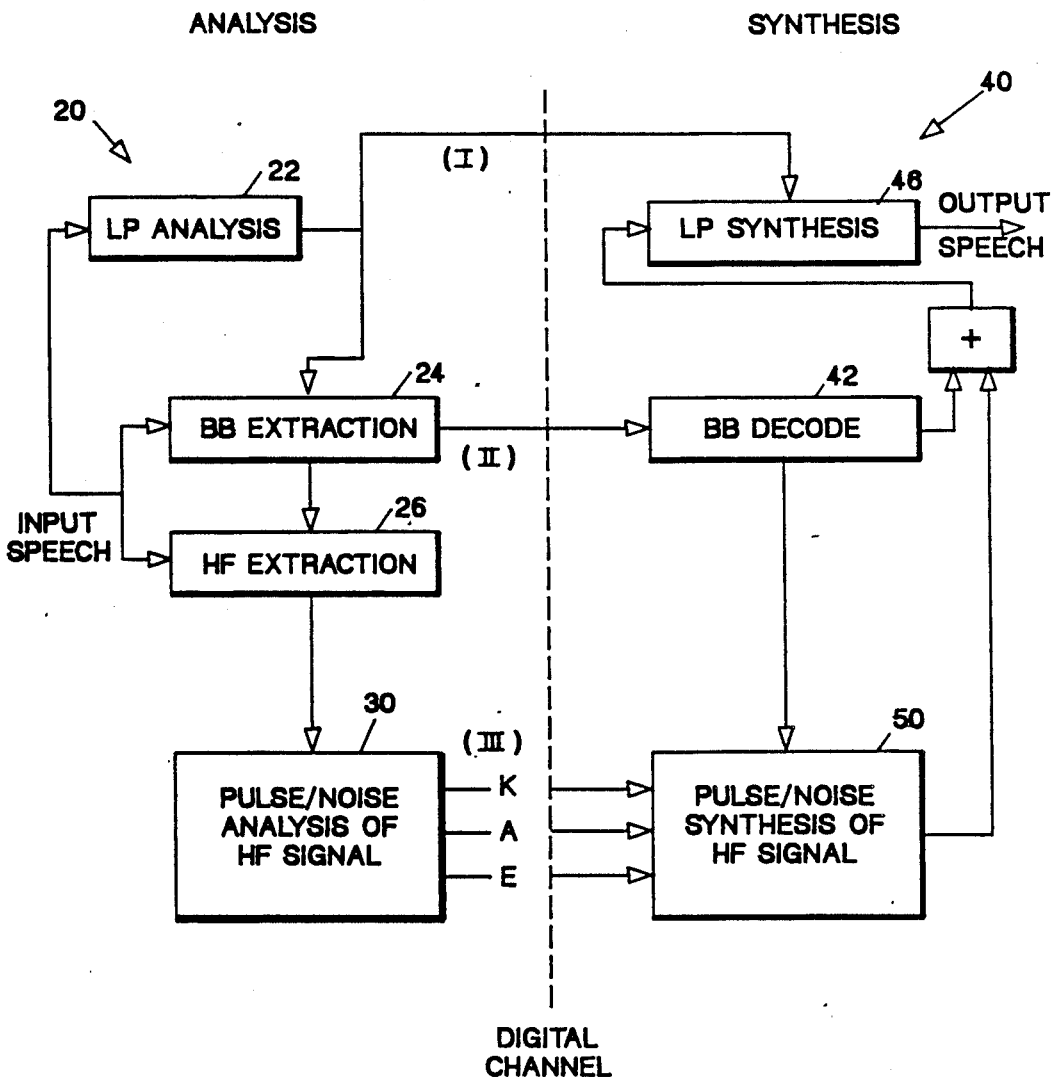
FIG. 2 is a general block diagram of the improved process as applied to a RELP vocoder.

FIG. 2 represents a block diagram of a RELP analyzer/synthesizer incorporating the invention. Some of the elements of a conventional RELP device have been retained unchanged. They have been given the same references or names as already used in connection with the device of FIG. 1.

In the analyzer the input speech is still processed to derive therefrom a set of coefficients (I) and a Base-Band BB (II). These data (I) and (II) are separately coded. But the third speech descriptors (III) derived through analysis of the high and low frequency bandwidth contents, differs from the descriptor (III) of a conventional RELP as represented in FIG. 1. These new descriptors might be generated using different methods and vary a little from one method to another. They will however all include data characterizing to a certain extent the energy contained in the upper (HF) band as well as the phase relation (phase shift) between high and low bandwidth contents. In the preferred embodiment of FIG. 2 these new descriptors have been designated by K, A and E respectively standing for phase, amplitude and energy. They will be used for the speech synthesis operations to synthesize the speech upper band contents.

Figure 3:
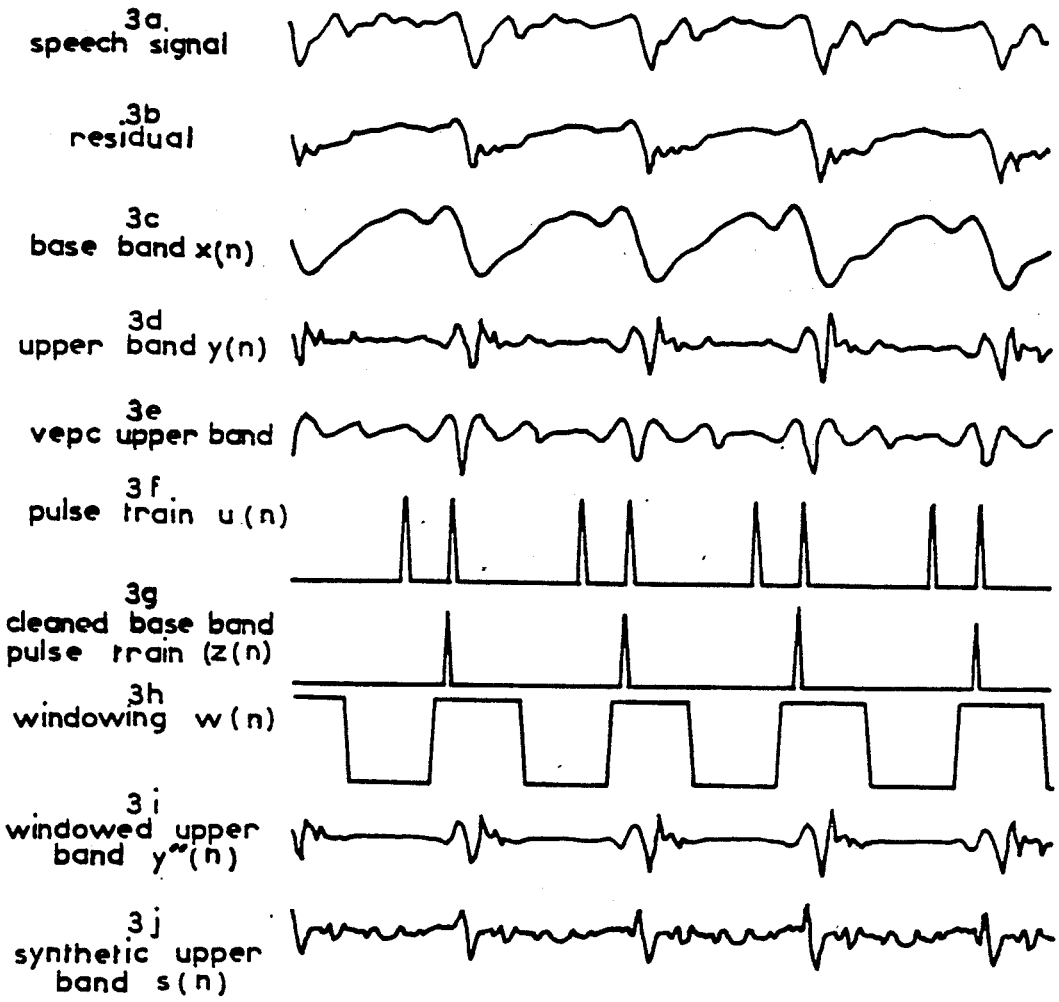
FIG. 3 shows typical signal wave-forms obtained with the improved process.

A better understanding of the proposed new process and more particularly of the significance of the considered parameters or speech descriptors will be made easier with the help of FIG. 3 showing typical waveforms. For further details on this RELP coding technique one may refer to the above mentioned references.

As already mentioned, some roughness still remains in the synthesized signal when processed as above indicated. The present invention enables avoiding said roughness by representing the high frequency signal in a more sophisticated way.

The advantage of the proposed method over the conventional method consists in a representation of the high-frequency signal by a pulse/noise model (see blocks 30, 50 in FIG. 2). The principle of the proposed method will be explained with the help of FIG. 3 which shows typical wave-forms of a speech segment (FIG. 3*a*) and the corresponding residual (FIG. 3*b*), base-band (FIG. 3*c*), and high-frequency (or upper-band) (FIG. 3*d*) signals.

Figure 4:
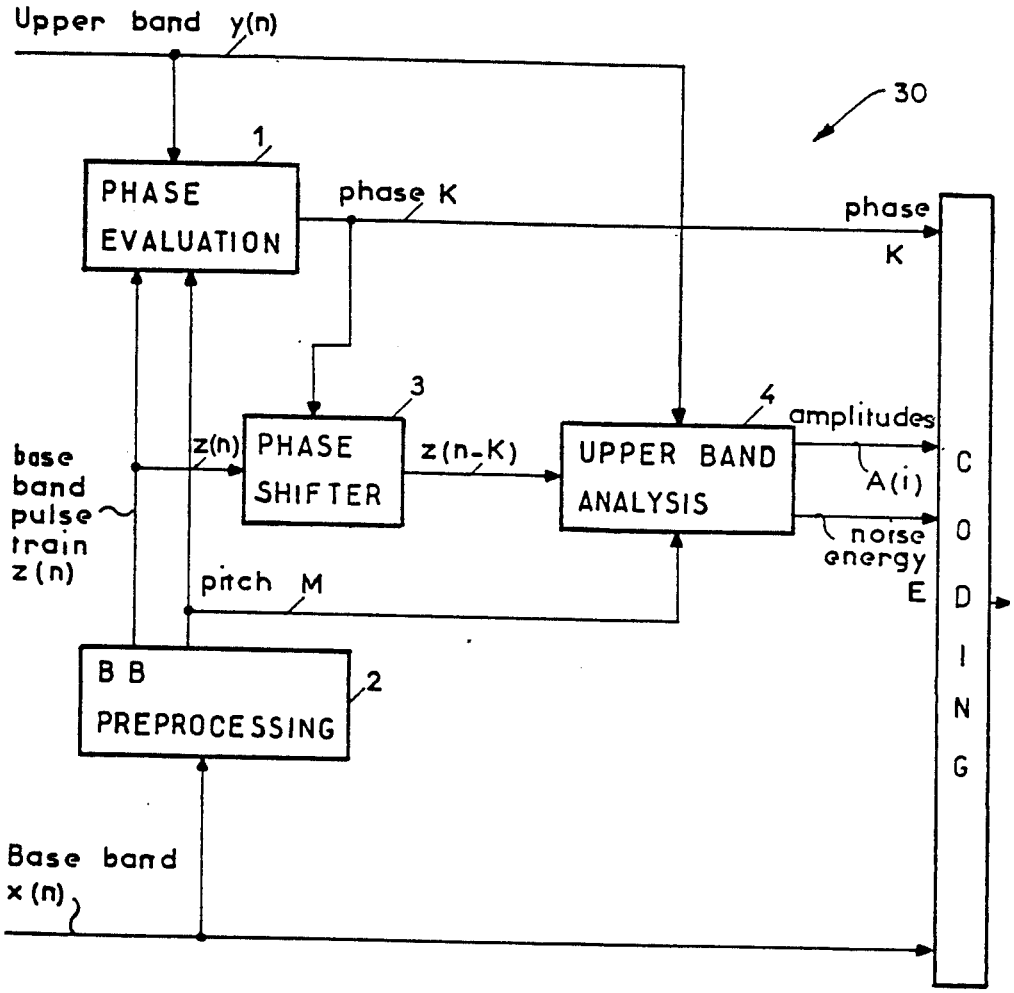
FIG. 4 represents a detailed block diagram of the improved pulse/noise analysis of the upper-band signal.

The problem faced with RELP vocoders is to derive at the receiver end (synthesizer 40) a synthetic high-frequency signal from the transmitted base-band signal. As recalled above, the classical way to reach this objective is to capitalize on the harmonic structure of the speech by making a non-linear distortion of the base-band signal followed by a high-pass filtering and a level adjustment according to the transmitted energy. The signal obtained through these operations in the example of FIG. 3 is shown in FIG. 3*e*. The comparison of this signal with the original one (FIG. 3*d*) shows, in this example, that the synthetic high-frequency signal exhibits some amplitude overshoots which furthermore result in substantial audible distortions in the reconstructed speech signal. Since both signals have very close amplitude spectra, the difference comes from the lack of phase spectra matching between both signals. The process proposed here makes use of a time domain modeling of the high-frequency signal, which allows reconstructing both amplitude and phase spectra more precisely than with the classical process. A careful comparison of the high-frequency (FIG. 3*d*) and base-band signals (FIG. 3*c*) reveals that although the high-frequency signal does not contain the fundamental frequency, it looks like it contains it. In other words, both the high-frequency and the base-band signals exhibit the same quasi-periodicity. Furthermore, most of the significant samples of the high-frequency signal are concentrated within this periodicity. So, the basic idea behind the proposed method is twofold: it first consists in coding only the most significant samples within each period of the high-frequency signal; then, since these samples are periodically concentrated at the pitch period which is carried by the base-band signal, only transmit these samples to the receiving end, (synthesizer 40) and locate their positions with reference to the received base-band signal. The only information required for this task is the phase between the base-band and the high-frequency signals. This phase, which can be characterized by the delay between the pitch pulses of the base-band signal and the pitch pulses of the high-band signal, must be determined in the analysis part of the device and transmitted. In order to illustrate the proposed method, the next section describes a preferred embodiment of the Pulse/Noise Analysis 30 (illustrated in FIG. 4) and Pulse/Noise Synthesis 50 (illustrated in FIG. 5) means made to improve a VEPC coder according to the present invention. In the following, x(nT) or simply x(n) will denote the nth sample of the signal x(t) sampled at the frequency 1/T. Also it should be noted that the voice signal is processed by blocks of N consecutive samples as performed in the above cited reference, using BCPCM techniques. FIG. 4 shows a detailed block diagram of the pulse/noise analyser 30 in which the base-band signal x(n) and high-band signal y(n) are processed so as to determine, for each block of N samples of the speech signal a set of enhanced high-frequency (HF) descriptors which are coded and transmitted: the phase K between the base-band signal and the high-frequency signal, the amplitudes A(i) of the significant pulses of the high-frequency signal, and the energy E of the noise component of the high-frequency signal. The derivation of these HF descriptors is implemented as follows.

Figure 7:
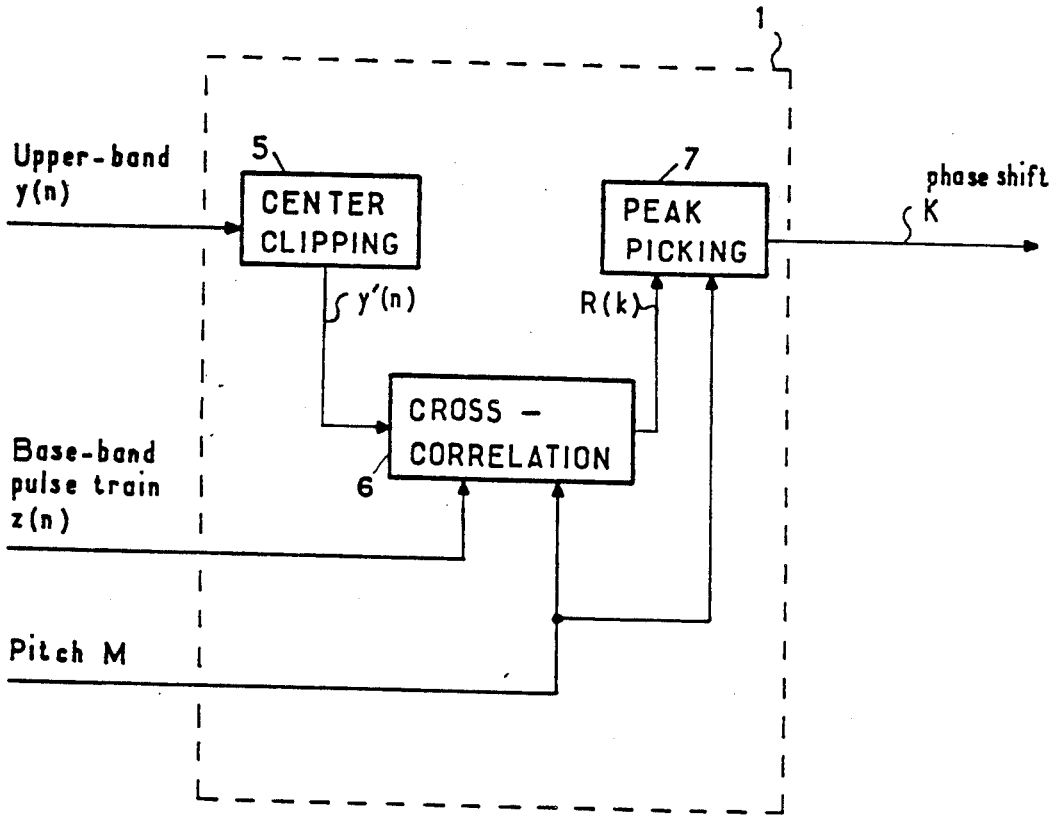
FIG. 7 represents the block diagram of a preferred embodiment of the phase evaluation building block appearing in FIG. 4.

The first processing task consists in the evaluation, in device (1) of FIG. 4, of the phase delay K between the base-band signal and the high-frequency signal. This is performed by computation of the cross correlation between the base-band signal and the high-frequency signal. Then a peak picking of the cross-correlation function gives the phase delay K. FIG. 7 will show a detailed block diagram of the phase evaluation device (1). In fact, the cross-correlation peak can be much sharpened by pre-processing both signals prior to the computation of the cross-correlation. The base-band signal x(n) is pre-processed in device (2) of FIG. 4, so as to derive the signal z(n) (see 3g in FIG. 3) which would ideally consist of a pulse train at the pitch frequency, with pulses located at the time positions corresponding to the extrema of the base-band signal x(n).

Figure 6:
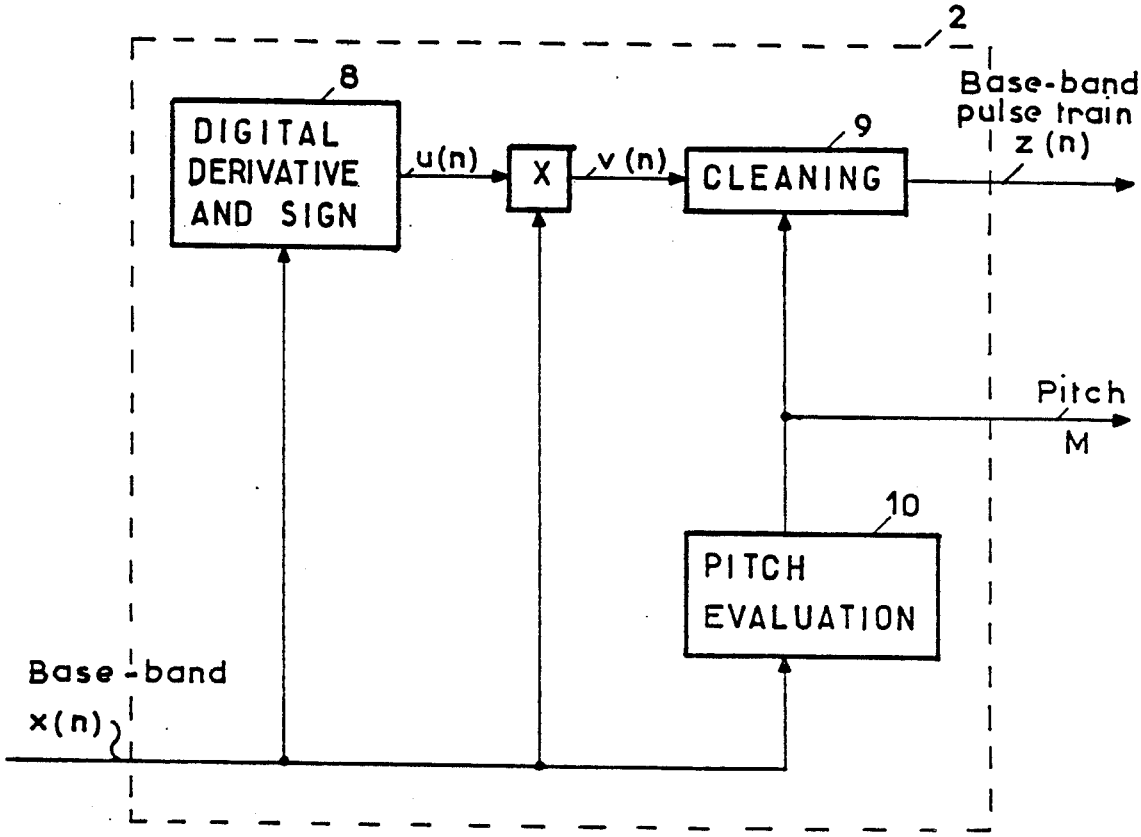
FIG. 6 represents the block diagram of a preferred embodiment of the base-band pre-processing building block of FIG. 4 and FIG. 5.

The pre-processing device (2) is shown in detail on FIG. 6. A first evaluation of the pulse train is achieved in device (8) implementing the non-linear operation:

$$c'(n)=\text{sign } x(n)-x(n-1) \quad (1)$$

$$c(n)=\text{sign } (c'(n)-c'(n-1))$$

$$u(n)=c(n)\times(n) \text{ if } c(n)>0 \quad (2)$$

$$u(n)=0 \text{ if } c(n)<=0$$

for n=1, . . . ,N, and where the value x(−1) and x(−2) obtained in relation (1) for n=1 and n=2 correspond respectively to the x(N) and x(N−1) values of the previous block which is supposed to be memorized from one block to the next one. For reference, FIG. 3f represents the signal u(n) obtained in our example. The output pulse train is then modulated by the base-band signal x(n) to give the base-band pulse train v(n):

$$v(n)=u(n)\times(n) \quad (3)$$

The base-band pulse train v(n) contains pulses both at the fundamental frequency and at harmonic frequencies. Only fundamental pulses are retained in the cleaning device (9). For that purpose, another input to device (9) is an estimated value M of the periodicity of the input signal obtained by using any conventional pitch detection algorithm implemented in device (10). For example, one can use a pitch detector, as described in the paper entitled 'Real-Time Digital Pitch Detector' by J. J. Dubnowski, R. W. Schafer, and L. R. Rabiner in the IEEE Transactions on ASSP, VOL. ASSP-24, No. 1, February 1976, pp. 2–8.

Figure 10:
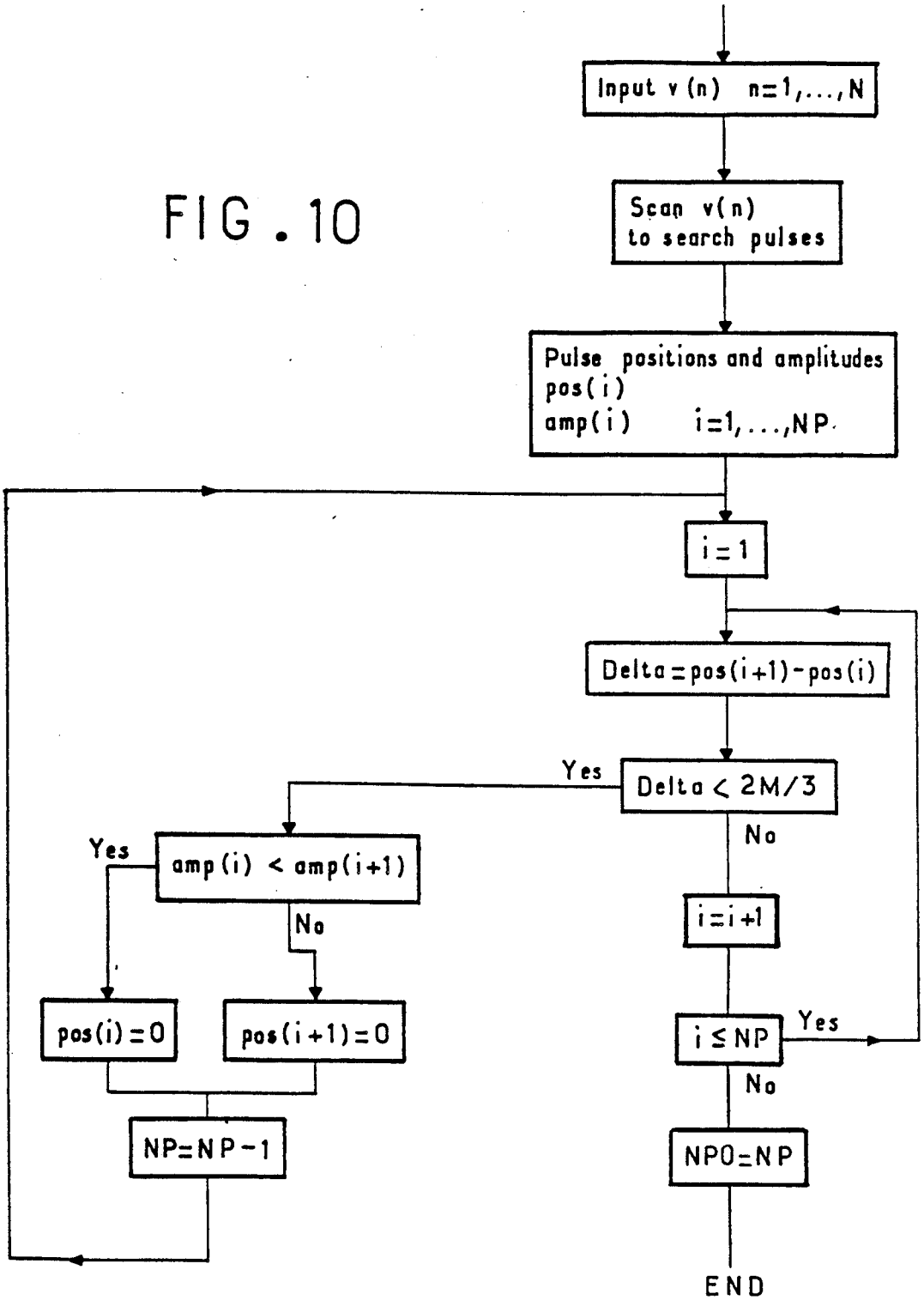
FIG. 10 represents the block diagram of the base-band pulse train cleaning device (9).
Figure 11:
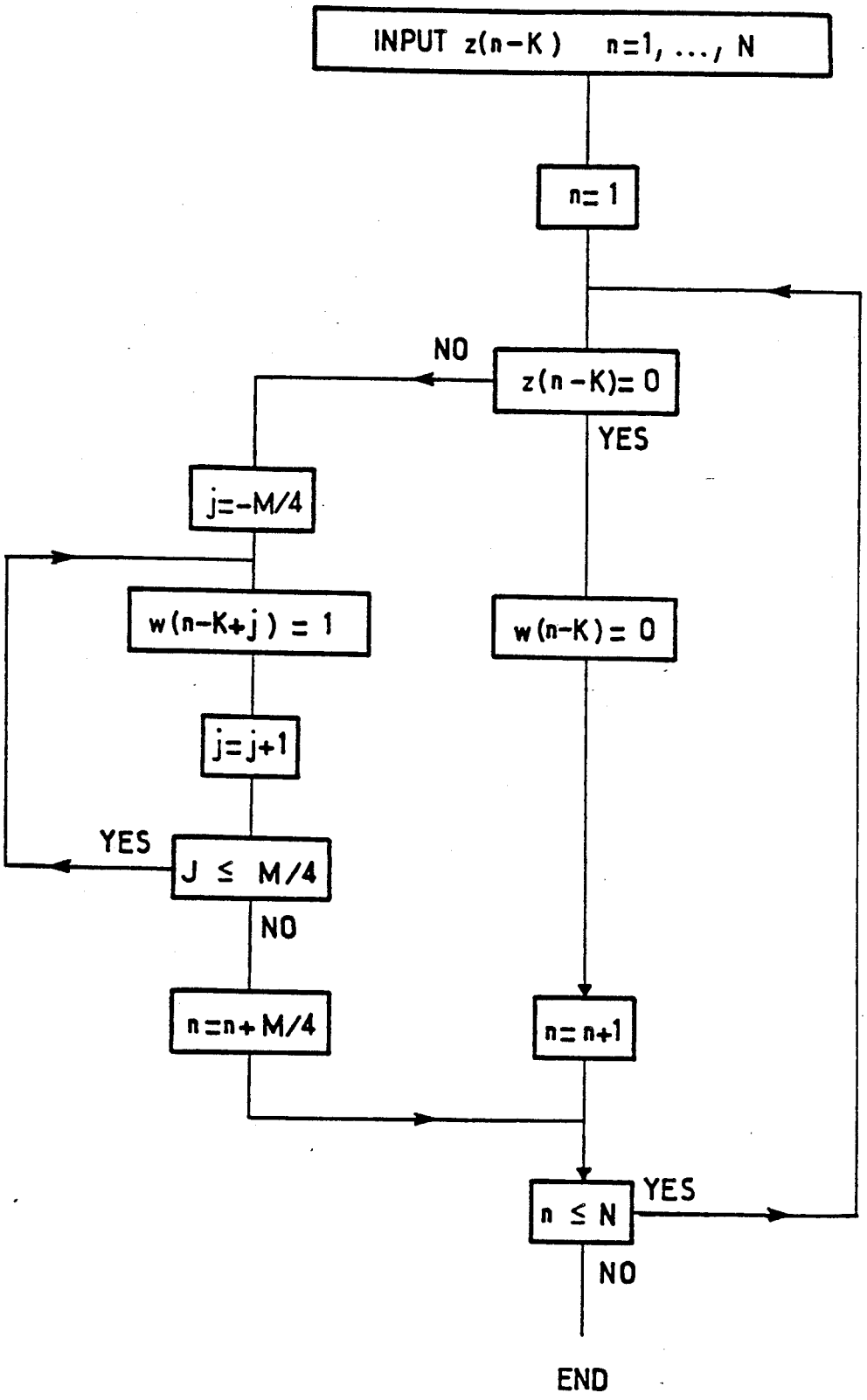
FIG. 11 represents the block diagram of the windowing device (11)

Referring to FIG. 6, the base-band pulse train v(n) is processed by the cleaning device (9) according to the following algorithm depicted in FIG. 10. The sequence v(n), (n=1, . . .,N) is first scanned so as to determine the positions and respective amplitudes of its non-null samples (or pulses). These values are stored in two buffers pos(i) and amp(i) with i=1, . . . ,NP, where NP represents the number of non-null pulses. Each non-null value is then analyzed with reference to its neighbor. If their distance, obtained by subtracting their positions is greater than a prefixed portion of the pitch period M (we took 2M/3 in our implementation), the next value is analyzed. In the other case, the amplitudes of the two values are compared and the lowest is eliminated. Then, the entire process is re-iterated with a lower number of pulses (NP−1), and so on until the cleaned base-band pulse train z(n) comprises remaining pulses spaced by more than the pre-fixed portion of M. The number of these pulses is now denoted NP0. Assuming a block of samples corresponding to a voiced segment of speech, the number of pulses is generally low. For example, assuming a block length of 20 ms, and given that the pitch frequency is always comprised between 60 Hz for male speakers and 400 Hz for female speakers, the number NP0 will range from 1 to 8. For unvoiced signals however, the estimated value of M may be such that the number of pulses become greater than 8. In this case, it is limited by retaining the first 8 pulses found. This limitation does not affect the proposed method since in unvoiced speech segments, the high-band signal does not exhibit significant pulses but only noisy signals. So, as described below, the noise component of our pulse/-noise model is sufficient to ensure a good representation of the signal.

For reference purposes, the signal z(n) obtained in our example is shown on FIG. 3g.

Coming back to the detailed block diagram of the phase evaluation device (1) shown in FIG. 7, the upper band signal y(n) is pre-processed by a conventional center clipping device (5). For example, such a device is described in detail in the paper 'New methods of pitch extraction' by M. M. Sondhi, in IEEE Trans. Audio Electroacoustics, vol. AU-16, pp. 262–266, June 1968.

The output signal y'(n) of this device is determined according to:

$$y'(n) = \begin{cases} y(n) & \text{if } y(n) > a^{\circ} Y\max \\ 0 & \text{if } y(n) \leqq a^{\circ} Y\max \end{cases} \quad (4)$$

where:

$$Y\max = \text{Max } y(n), n=1,N \quad (5)$$

Ymax represents the peak value of the signal over the considered block of N samples and is computed in device (5). 'a' is a constant that we took equal to 0.8 in our implementation.

Then, the cross-correlation function R(k) between the pre-processed high-band signal y'(n) and the base-band pulse train z(n) is computed in device 6 according to:

$$R(k) = \sum_{n=1}^{N-k} y'(n) \cdot z(n+k) \quad k = 0, \ldots, M \quad (6)$$

The lag K of the extremum R(K) of the R(k) function is then searched in device (7) and represents the phase shift between the base-band and the high-band:

$$R(K) = \underset{k=1,M}{\text{Max}} R(k) \quad (7)$$

Now referring back to the general block diagram of the proposed analyser shown on FIG. 4, the base-band pulse train z(n) is shifted by a delay equal to the previously determined phase K, in the phase shifter circuit (3). The circuit contains a delay line with a selectable delay equal to phase K. The output of the circuit is the shifted base-band pulse train z(n−K).

Both the high-band y(n) and the shifted base-band pulse train z(n−K) are then forwarded to the upper-band analysis device (4), which derives the amplitudes A(i) (i=1, . . . ,NP0) of the pulses and the energy E of the noise used in the pulse/noise modeling.

Figure 8:
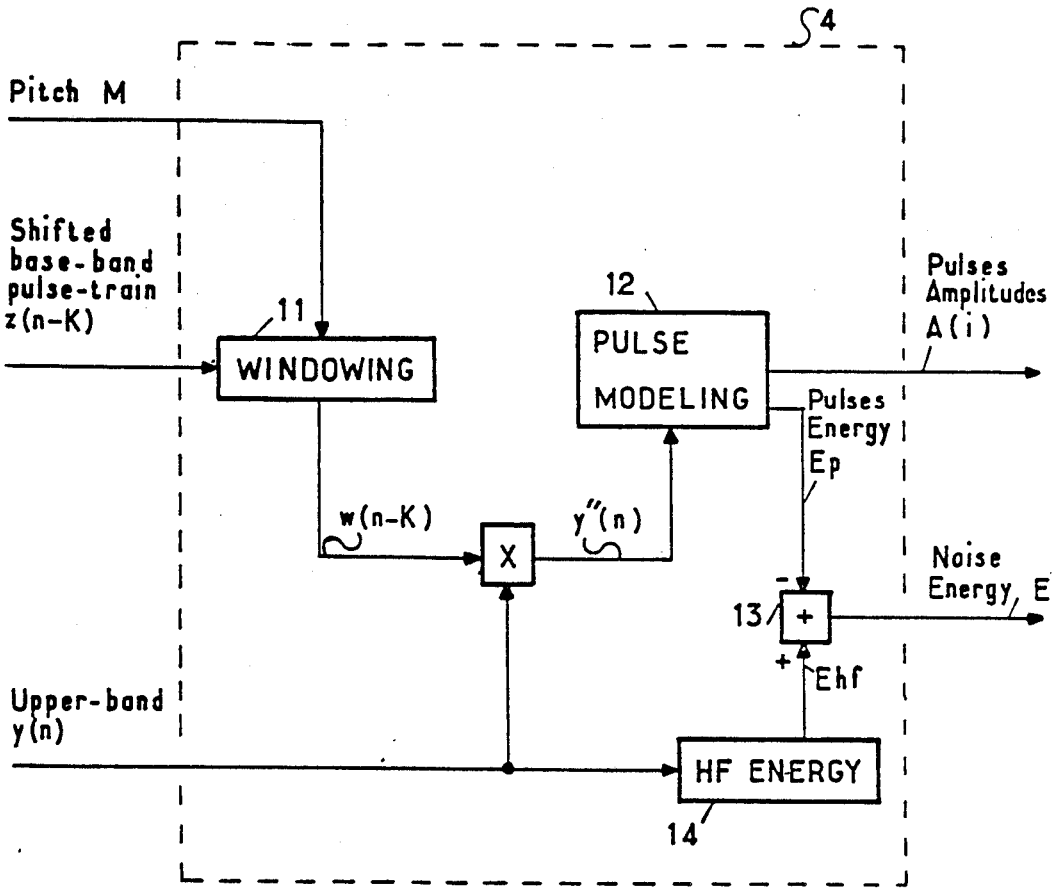
FIG. 8 represents the block diagram of a preferred embodiment of the upper-band analysis building block appearing in FIG. 4.

FIG. 8 shows a detailed block diagram of device (4). The shifted base-band pulse train z(n−K) is processed in windowing device (11) so as to derive a rectangular time window w(n−K) with windows of width (M/2) centered on the pulses of the base-band pulse train.

The upper-band signal y(n) is then modulated by the windowing signal w(n−K) as follows $$y''(n)=y(n)\cdot w(n-K). \tag{8}$$

For reference, FIG. 3*i* shows the modulated signal y"(n) obtained in our example. This signal contains the significant samples of the high-frequency band located at the pitch frequency, and is forwarded to device (12) which actually implements the pulse modeling as follows. For each of the NP0 windows, the peak value of the signal is searched:

$$A\max(i) = \max_{n=-M/4,\, M/4} y''(i, n) \tag{9}$$

$$A\min(i) = \min_{n=-M/4,\, M/4} y''(i, n) \tag{10}$$

where y"(i,n) represents the samples of the signal y"(n) within the ith window, and n represents the time index of the samples within each window, and with reference to the center of the window.

$$A(i) = \left[\frac{A^2_{max(i)} + A^2_{min(i)}}{2}\right]^{\frac{1}{2}} \tag{11}$$

The global energy Ep of the pulses is computed according to:

$$Ep = \sum_{i=1}^{NPO} A^2(i) \tag{12}$$

The energy Ehf of the upper-band signal y(n) is computed over the considered block in device (14) according to:

$$Ehf = \sum_{n=1}^{N} y^2(n) \tag{13}$$

These energies are subtracted in device (13) to give the noise energy descriptor E which will be used to adjust the energy of the remote pulse/noise model.

$$E=Ehf-Ep \tag{14}$$

The various coding and decoding operations are respectively performed within the analyzer and synthesizer according to the following principles.

As described in the paper by D. Esteban et al. in the ICASSP 1978 in Tulsa, the base-band signal is encoded with the help of a sub-band coder using an adaptive allocation of the available bit resources. The same algorithm is used at the synthesis part, thus avoiding the transmission of the bit allocation.

The pulse amplitude A(i), i=1,NP0, are encoded by a Block Companded PCM quantizer, as described in a paper by A. Croisier, at the 1974 Zurich Seminar: 'Progress in PCM and Delta modulation: block companded coding of speech signals'.

The noise energy E is encoded by using a non-uniform quantizer. In our implementation, we used the quantizer described in the VEPC paper herein above referenced on the Voice Excited Predictive Coder (VEPC).

Figure 5:
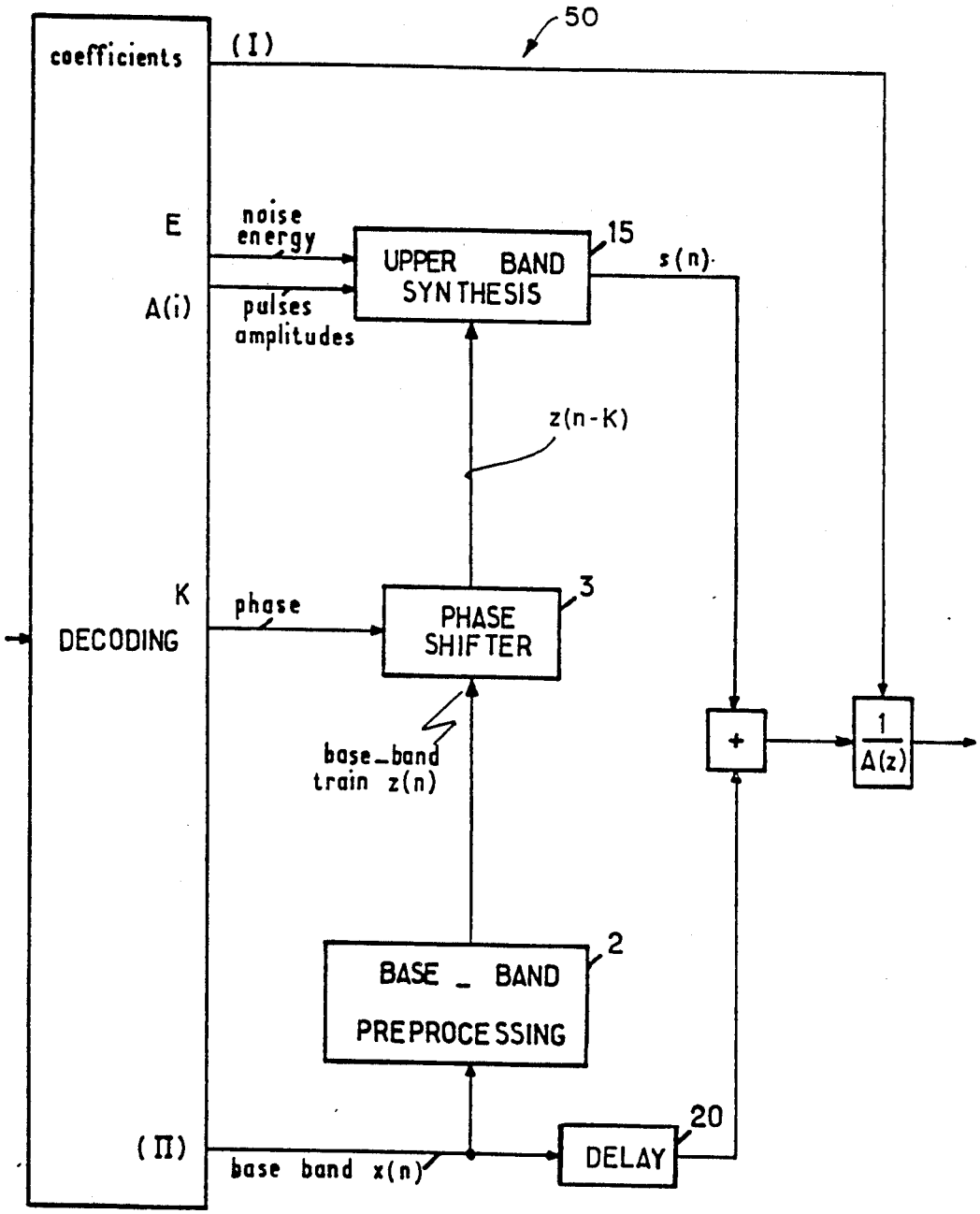
FIG. 5 represents a detailed block diagram of the improved pulse/noise synthesis of the upper-band signal.

The phase K is not encoded, but transmitted with 6 bits. FIG. 5 shows a detailed block diagram of the pulse/noise synthesizer. The synthetic high-frequency signal s(n) is generated using the data provided by the analyzer.

The decoded base-band signal is first pre-processed in device (2) of FIG. 5 in the same way it was processed at the analysis and described with reference to FIG. 6 to derive a Base-Band pulse train z(n) therefrom; and the K parameters are then used in a phase shifter (3) identical to the one used in the analysis part of device, to generate a replica of the pulse components z(n−K) of the original high-frequency signal.

Figure 9:
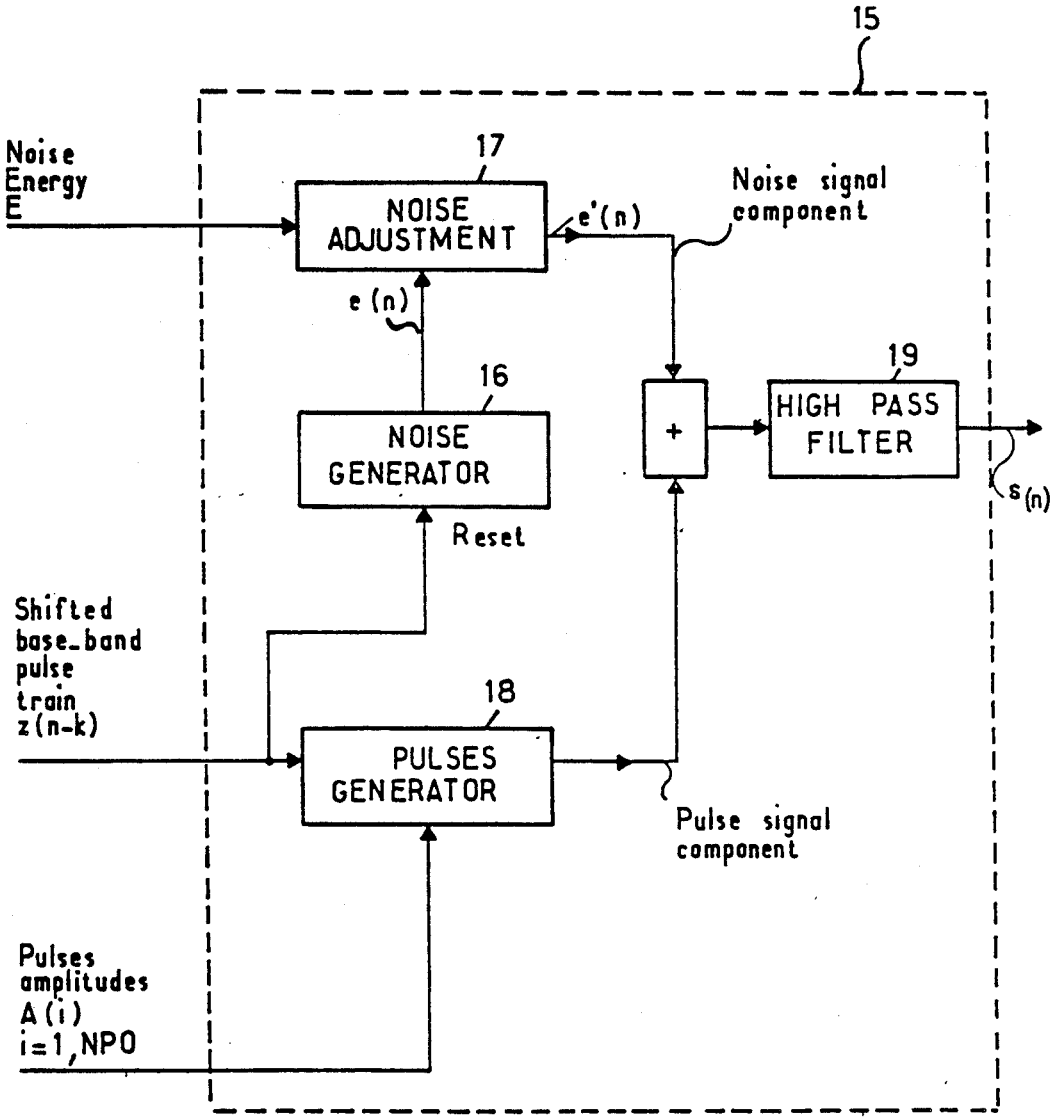
FIG. 9 represents the block diagram of a preferred embodiment of the upper-band synthesis building block appearing in FIG. 5.

Finally, the shifted base-band pulse train z(n−K), the A (i) parameters, and the E parameter are used to synthesize the upper band according to the pulse/noise model in device (15), as represented in FIG. 9.

This high-frequency signal s(n) is then added to the delayed base-band signal to obtain the excitation signal of the predictor filter to be used for performing the LP Synthesis function of FIG. 2.

FIG. 9 shows a detailed block diagram of the upper-band synthesis device (15). The synthetic high-band signal s(n) is obtained by the sum of a pulse signal and of a noise signal. The generation of each of these signals is implemented as follows.

The function of the pulses generator (18) is to create a pulse signal matching the positions and energy characteristics of the most significant samples of the original high-band signal. For that purpose, recall that the pulse train z(n−K) consists in NP0 pulses at the pitch period located at the same time positions as the most significant samples of the original high-band signal. The shifted base-band pulse train z(n−K) is sent to the pulses generator device (18) where each pulse is replaced by a couple of pulses and is further modulated by the corresponding window amplitude A(i), (i=1, . . . ,NP0).

The noise component is generated as follows. A white noise generator (16) generates a sequence of noise samples e(n) with unitary variance. The energy of this sequence is then adjusted in device (17), according to the transmitted energy E. This adjustment is made by a simple multiplication of each noise sample by (E)**.5.

$$e'(n)=e(n)E^{\frac{1}{2}} \tag{15}$$

In addition, the noise generator is reset at each pitch period so as to improve the periodicity of the full high-band signal s(n). This reset is achieved by the shifted pulse train z(n−K).

The pulse and noise signal components are then summed up and filtered by a high-pass filter 19 which removes the (0–1000 Hz) of the upper-band signal s(n). Note in FIG. 5 that the delay introduced by the high-pass filter on the high-frequency band is compensated by a delay (20) on the base-band signal. For reference, FIG. 3*j* shows the upper-band signal s(n) obtained in our example.

Although the invention was described with reference to a preferred embodiment, several alternatives may be used by a man skilled in the art without departing from the scope of the invention, bearing in mind that the basis of the method is to reconstruct the high-frequency component of the residual signal in a RELP coder with a correct phase K with reference to the low frequency component (base-band). Several alternatives may be used to measure and transmit this phase K with respect to the base-band signal itself. This choice allows the device to align the regenerated high-frequency signal with the help of only the transmitted phase K. Another implementation could be based on the alignment of the high-frequency signal with respect to the block boundary. This implementation would be simpler but would require the transmission of more information, i.e., the phase with respect to the block boundary would require more bits than the transmission of the phase with respect to the base-band signal.

Note also that instead of re-computing the pitch period in (M) the synthesis part of the device, this period could be transmitted to the receiver. This would save processing resources, but at the price of an increase in transmitted information.

We claim:

1. A process for coding a voice signal comprising a block of a predetermined number of samples corresponding to a voiced segment of speech wherein said voice signal is analyzed by being split into a low frequency (LF) bandwidth and a high frequency bandwidth the signal contents of which are to be coded separately, said process being characterized in that it includes:

coding said low frequency bandwidth signal;

processing said high frequency-bandwidth contents to derive therefrom high frequency bandwidth energy information;

processing both said low frequency bandwidth and said high frequency bandwidth contents to derive therefrom information relative to the phase shift between said high frequency signal and said low frequency signal;

coding separately said high frequency bandwidth energy information and said phase shift information; grouping into a set of descriptors for transmission said coded low frequency bandwidth signal, said coded high frequency bandwidth energy information and said coded phase shift information to form the coded representation of said voice signal.

2. A process according to claim 1 wherein said voice signal is initially processed using the conventional BCPCM process.

3. A process according to claim 1 wherein said processing to derive high frequency bandwidth energy information includes:

measuring the voice pitch period M;

defining a rectangular time window of width M/2 within the segment of speech occurring at the pitch rate;

measuring the high frequency bandwidth energy within said time window and generating data representing said HF energy within said time window; and generating noise energy data for each segment of speech, by subtracting said high frequency bandwidth energy over said time window from the high frequency energy over the segment of speech.

4. A process according to claim 3 wherein said windowed HF energy is represented by a predetermined number of samples within the time window.

5. A coding process according to claim 4 wherein said predetermined number of samples are limited to peak values through a center clipping operation using a self adaptive threshold level.

6. A coding process according to claim 5 wherein said threshold level is adjusted to eliminate a predetermined percentage of signal samples within the high frequency bandwidth contents.

7. A process for coding voice signals according to claim 1 based on Voice Excited Predictive coding techniques wherein said voice signal is also used to derive a linear set of prediction parameters, said parameters being also multiplexed with said coded low frequency bandwidth component, said coded high frequency energy information and said coded phase shift information.

8. A process for decoding a voice signal coded according to claim 7 using synthesis operations including:

demultiplexing and decoding said coded representation of said voice signal to obtain the decoded low frequency bandwidth data, the decoded high frequency energy information, and the decoded phase shift information;

shifting said low frequency bandwidth decoded data using said phase shift information;

combining said shifted low frequency decoded data with said decoded high frequency bandwidth energy data to derive therefrom an synthesized upper band signal; and adding said low frequency bandwidth signal and said synthesized upper band signal.

9. A decoding process according to claim 8 wherein said decoding process further includes:

demultiplexing and decoding said linear prediction parameters;

using said decoded linear prediction parameters to adjust a synthesis filter fed with the signal provided by said adding operation.

10. A coding process according to claim 1 wherein said low frequency bandwidth signal is coded using split band techniques, with dynamic allocation of quantizing resources throughout the split band contents.

11. A Voice Excited Predictive Coder (VEPC) including first means sensitive to the voice signal for generating spectral descriptors representing linear prediction parameters, second means for generating a low frequency or base band signal (x(n)) and third means for generating high frequency (HF) or upper band signal descriptors of the upper band signal y(n), said third means including:

base band preprocessing means connected to said second means for generating a pitch parameter M and a cleaned base band pulse train z(n);

phase evaluation means connected to said base band preprocessing means and sensitive to said upper band signal to derive therefrom a phase shift descriptor K;

phase shifter means sensitive to said base band pulse train z(n) and to said phase shift descriptor K to derive therefrom a shifted pulse train z(n-K);

upper band analysis means sensitive to said upper band signal y(n), to said shifted pulse train z(n-K) and to said pitch parameter M, to derive therefrom noise energy information E and HF amplitude information A(i); and, coding means for coding said phase shift descriptor K, amplitude A(i), noise energy E and base band signal x (n).

12. A VEPC coder according to claim 11 wherein said base band preprocessing means include:

digital derivative and sign means sensitive to said base-band signal x(n) to derive therefrom a signal represented by a pulse train u(n) derived according to the following expressions:

$$u(n)=c(n)\cdot\times(n) \text{ if } c(n)>0$$

or $$u(n)=0 \text{ if } c(n)\leqq 0$$

wherein c(n)=sign (c'(n)−c'(n−1)) and c'(n)=(n)−x(n−1)

modulating means sensitive to u(n) and x(n) to derive therefrom a modulated base band pulse train signal v(n)=u(n)·x(n);

pitch evaluation means, sensitive to said base band signal x(n) to derive therefrom the pitch parameter M; and, cleaning means sensitive to said modulated base band pulse train signal v(n) and pitch parameter M to derive therefrom a cleaned base band pulse train z (n) containing base band pulses spaced by more than a prefixed portion of M.

13. A VEPC according to claim 11 wherein said phase evaluation means include:

center clipping means sensitive to said upper band signal y(n) to derive therefrom a clipped signal y'(n), with:

$$y'(n)=y(n) \text{ if } y(n)>a\cdot Y\max$$

or $$=0 \text{ if } y(n)\leqq a\cdot Y\max$$

where Ymax=Max y(n), n=1, N N being a predetermined block number of samples and "a" a predetermined constant coefficient;

cross correlation means, sensitive to said clipped signal y'(n), cleaned base band pulse train z(n) and pitch parameter M, to derive therefrom a cross correlation function R(k), with:

$$R(k)=\sum_{n=1}^{N-k} y'(n)\cdot z(n+k),\ k=0,\ldots M;$$

peak picking means sensitive to said cross correlation function R(k) and pitch parameter M to derive phase shift value K through the extremum of R(K), with:

$$R(K)=\text{Max } R(k), k=1,M$$

14. A VEPC according to claim 11 wherein said phase shifter is a delay line adjustable by the phase shift value K to derive a shifted pulse train z(n−K).

15. A VEPC synthesizer for decoding a voice signal coded through a device according to claim 11, said synthesizer including decoding means for decoding said linear prediction parameters, said E, A(i), K and x(n);

base-band preprocessing means sensitive to said base band signal x(n) to derive a cleaned base-band pulse train z(n);

phase shifter means sensitive to said cleaned base-band pulse train z(n) and K to derive a shifted base-band pulse train z(n−K);

upper band synthesis means sensitive to E, A(i) and shifted base-band pulse train z(n−K) to derive synthetic high frequency signal s(n);

summing means for summing said synthetic upper band signal s(n) and adelayed base-band signal x(n);

LP synthesis filter tuned by said decoded linear prediction parameters and sensitive to the output of said summing means to derive the synthesized voice signal.

16. A VEPC synthesizer according to claim 15 wherein said upper band synthesis means include:

pulse generator means sensitive to A(i) and shifted base-band pulse train z(n−K) to derive a pulse signal component by replacing each pulse by a couple of pulses modulated by A(i);

noise generator means sensitive to said shifted base-band pulse train z(n−K) to derive a sequence of noise samples e(n);

noise adjusting means sensitive to each noise sample e(n) and to the noise energy E to derive a noise signal component $e'(n)=e(n)\cdot E^{\frac{1}{2}}$;

adding means for adding said noise signal component to said pulse signal component; and, high pass filter means connected to said adding means to provide said synthetic upper band signal s(n).

17. A VEPC Coder according to claim 11, wherein said upper band analysis means include:

windowing means sensitive to said shifted base-band pulse train z(n−K) and to said pitch parameter M to derive therefrom a rectangular time window pulse train w(n−K);

modulating means sensitive to said rectangular time window pulse train w(n−K) and to said upper band signal y(n) to derive a modulated upper band pulse train signal y''(n) through y''(n)=y(n) w(n−K);

a pulse modeling means sensitive to said modulated upper band pulse train signal y''(n) to derive pulse amplitudes A(i) through:

$$A(i)=\left[\frac{A^2_{max(i)}+A^2_{min(i)}}{2}\right]^{\frac{1}{2}}$$

with:

$$A\max(i)=\text{Max } y''(i,n), n=-M/4, M/4$$

and $$A\min(i)=\text{Min } y''(i,n), n=-M/4, M/4$$

where y''(i,n) represent the samples of modulated upper band pulse train y''(n) within the ith window, and n represents the time index of the samples within each window;

said pulse modeling means also providing pulse energy $$Ep=\sum_{i=1}^{NPO} A^2(i), \text{ where } NPO \text{ is the number}$$

of pulses within a cleaned base band train z(n) per predetermined block of voice samples;

HF energy means sensitive to upper band signal y(n) to derive $$Ehf=\sum_{n=1}^{N} y^2(n); \text{ and,}$$

noise energy E generating means derived from

* * * * *